US010064475B2

(12) United States Patent
Wolfsgruber et al.

(10) Patent No.: US 10,064,475 B2
(45) Date of Patent: Sep. 4, 2018

(54) FOLDABLE APPLICATOR

(71) Applicant: GEKA GmbH, Bechhofen (DE)

(72) Inventors: Dieter Wolfsgruber, Burgoberbach (DE); Pilar Kempe-Gonzalez, Ansbach (DE); Nicholas Bakic, Hilpertsweiler-Schnelldorf (DE); Erwin Schuster, Bechhofen (DE)

(73) Assignee: GEKA GmbH, Bechhofen (DE)

( * ) Notice: Subject to any disclaimer, the term of this patent is extended or adjusted under 35 U.S.C. 154(b) by 80 days.

(21) Appl. No.: 14/429,311

(22) PCT Filed: Sep. 18, 2013

(86) PCT No.: PCT/EP2013/069410
§ 371 (c)(1),
(2) Date: Mar. 18, 2015

(87) PCT Pub. No.: WO2014/044725
PCT Pub. Date: Mar. 27, 2014

(65) Prior Publication Data

US 2015/0216286 A1 Aug. 6, 2015

(30) Foreign Application Priority Data

Sep. 18, 2012 (DE) ..... 20 2012 103 567 U

(51) Int. Cl.

| | |
|---|---|
| ***A46B 7/06*** | (2006.01) |
| ***A45D 40/26*** | (2006.01) |
| ***A46B 3/20*** | (2006.01) |
| ***A46B 5/00*** | (2006.01) |
| ***A46B 9/02*** | (2006.01) |
| ***A46B 7/02*** | (2006.01) |

(52) U.S. Cl.
CPC ..... *A45D 40/267* (2013.01); *A46B 3/20* (2013.01); *A46B 5/0029* (2013.01); *A46B 7/02* (2013.01); *A46B 9/021* (2013.01); *A46B 9/026* (2013.01); *A46B 7/06* (2013.01)

(58) Field of Classification Search
CPC ..... A45D 40/267; A46B 9/02; A46B 3/20; A46B 5/0029; A46B 7/06
USPC ..... 401/121, 122, 123, 126, 127, 129
See application file for complete search history.

(56) References Cited

U.S. PATENT DOCUMENTS 1,687,079 A * 10/1928 Barker ..... A46B 9/04 15/110
2,796,620 A * 6/1957 Bressler ..... A46B 5/0025 15/201

(Continued)

FOREIGN PATENT DOCUMENTS

FR 2916328 11/2008
WO 2011161584 A1 12/2011

(Continued)

*Primary Examiner* — David Walczak
*Assistant Examiner* — Joshua Wiljanen

(57) ABSTRACT

A cosmetic applicator having a core that supports the application elements in the form of bristles and/or comb tines; the core has a central body that is itself equipped with a plurality of bristles and/or comb tines protruding out directly from it; the core is also composed of at least one arm that protrudes out from the central body and is itself equipped with a plurality of bristles and/or comb tines and is mobile relative to the central body.

15 Claims, 13 Drawing Sheets

(56) References Cited

U.S. PATENT DOCUMENTS 4,397,326 A * 8/1983 Formica ..... A45D 40/26 132/218
4,561,456 A * 12/1985 Gueret ..... A46B 1/00 132/159
4,662,385 A * 5/1987 Schefer ..... A45D 34/04 132/218
4,744,377 A * 5/1988 Dolan, Jr. ..... A45D 40/265 132/218
5,228,466 A * 7/1993 Klinkhammer ..... A46B 5/002 132/308
5,894,847 A * 4/1999 Gueret ..... A46B 3/18 132/218
6,681,777 B2 * 1/2004 Gueret ..... A45D 40/265 132/151
8,191,559 B2 * 6/2012 Bickford ..... A45D 34/045 132/218
8,528,572 B2 * 9/2013 Schwab ..... A45D 33/18 132/218
8,726,913 B2 * 5/2014 Weigel ..... A45D 40/265 132/218
8,783,451 B2 * 7/2014 Slokovic ..... A45D 34/04 206/15.2
9,032,972 B2 * 5/2015 Viegas ..... A45D 40/262 132/218
9,055,804 B2 * 6/2015 Ornoski ..... A45D 40/265
9,066,573 B2 * 6/2015 Pires ..... A45D 40/26
9,532,642 B2 * 1/2017 Zech ..... A46B 3/005
2004/0112398 A1 * 6/2004 Grant ..... A45D 24/00 132/151
2005/0249539 A1 * 11/2005 Habatjou ..... A45D 40/265 401/127
2006/0013639 A1 * 1/2006 Gueret ..... A45D 34/045 401/130
2007/0256700 A1 * 11/2007 Bodelin ..... A45D 34/042 132/218
2008/0083421 A1 * 4/2008 Malvar ..... A45D 40/267 132/218
2008/0271746 A1 * 11/2008 Gueret ..... A45D 40/265 132/218
2008/0286030 A1 * 11/2008 Roder ..... A45D 34/042 401/129
2009/0276973 A1 * 11/2009 Bouix ..... A45D 40/265 15/206
2010/0307529 A1 * 12/2010 Schwab ..... A45D 33/18 132/218
2011/0073127 A1 * 3/2011 Hermouet ..... A46B 9/021 132/218
2011/0094534 A1 * 4/2011 Bickford ..... A45D 34/045 132/218
2011/0297174 A1 * 12/2011 Ornoski ..... A45D 40/265 132/218
2012/0167910 A1 * 7/2012 Weigel ..... A45D 40/265 132/218
2012/0170965 A1 * 7/2012 Kulik ..... A46B 9/021 401/121
2012/0199158 A1 * 8/2012 Bickford ..... A45D 34/045 132/218
2013/0104924 A1 * 5/2013 Higgins ..... A46B 9/021 132/218
2014/0037364 A1 * 2/2014 Hartstock ..... A46B 1/00 401/270
2015/0117929 A1 * 4/2015 Schreiber ..... A45D 40/267 401/25
2015/0216286 A1 * 8/2015 Wolfsgruber ..... A45D 40/267 401/122
2015/0257514 A1 * 9/2015 Thierer ..... A46B 3/005 401/122
2015/0327662 A1 * 11/2015 Kim ..... A46B 9/021 401/118
2015/0335133 A1 * 11/2015 Kim ..... A46B 9/021 401/118
2015/0366325 A1 * 12/2015 Wolfsgruber ..... A46B 7/02 401/122

FOREIGN PATENT DOCUMENTS

WO 2012085398 A2 6/2012
WO WO 2012085398 A2 * 6/2012 ..... A45D 40/262

* cited by examiner

FOLDABLE APPLICATOR

FIELD OF THE INVENTION

The invention relates to a cosmetic applicator and in particular to a mascara applicator having a core that supports the application elements in the form of bristles and/or comb tines and the core has a central body that is itself equipped with a plurality of bristles and/or comb tines protruding out directly from it.

BACKGROUND OF THE INVENTION

In the prior art, an extremely wide variety of cosmetic applicators have been disclosed. Basically, as the core diameter of the applicator increases, the diameter of the wiper and the diameter of the opening in the neck of the bottle must also increase. This is particularly true with applicators in which the core and the bristles supported by it are composed of injection-molded plastic. The reason for this is that injection-molded bristles in particular, which often have only a limited bend recovery behavior, are at risk of being damaged even after a short time if the core from which they protrude is forced to pass through a wiper and/or bottle neck that is actually too narrow for its diameter when the applicator is pulled out of the cosmetic container.

For an applicator with a particularly large core diameter, it is therefore generally necessary to produce a separate wiper and a container that has a bottle neck that is especially adapted to the large core diameter. To do so, it is necessary to produce and store corresponding tools, which incurs costs.

The object of the invention, therefore, is to create a cosmetic applicator that has a greater independence from the inner diameter of the available wiper and/or the diameter of the neck of the available cosmetic container than prior designs.

SUMMARY OF THE INVENTION

The cosmetic applicator according to the invention is composed of a core that supports the application elements in the form of bristles and/or comb tines; the core has a central body that is itself equipped with a plurality of bristles and/or comb tines protruding out directly from it and the cosmetic applicator according to the invention is distinguished by the fact that its core is also composed of at least one arm protruding out from the central body and is itself equipped with a plurality of bristles and/or comb tines and is mobile relative to the central body.

The invention also proposes a cosmetic applicator with a core and bristles protruding outward from it, which is embodied as follows: according to the invention, the core is composed of a slotted tube. Its longitudinal axis extends parallel or coaxial to the longitudinal axis of the wand, which is preferably a component of the applicator, or constitutes the longitudinal axis of the applicator, which with proper use of the applicator extends essentially parallel to the part to which the cosmetic is to be applied.

Alternatively, the core is composed of a rod-shaped central body from which at least one arm protrudes.

In the context of the invention, a rod-shaped central body is understood to be a body with a dimension in a first direction that is greater than a dimension in the directions perpendicular to the first direction. In the context of the invention, the dimension of a rod-shaped central body in the first direction is preferably greater than the dimensions in each of the other directions by at least a factor of 3 or better still by at least a factor of 4. The above-mentioned first direction of the rod-shaped central body extends parallel or coaxial to the longitudinal axis of the wand, which is preferably a component of the applicator, or constitutes the longitudinal axis of the applicator, which extends essentially parallel to the part to which the cosmetic is to be applied. Preferably, the rod-shaped central body is embodied so that the imaginary central longitudinal axis of the actual applicator section, which is used for the application and is equipped with bristles and/or tines and in which its center of gravity lies, extends inside the solid material of the rod-shaped central body.

No matter which alternative is used for embodying the core, it is in any case distinguished by the fact that it is flexible at least in some regions so that during the passage through the wiper and/or the neck of the cosmetic container associated with the cosmetic applicator, the cross-sectional area occupied by the core automatically decreases under the influence of the forces that the wiper and/or the bottle neck of the cosmetic container exerts on the core until the corresponding part of the applicator has passed through the wiper and/or the bottle neck of the cosmetic container. In other words, an applicator is created, which has a core that flexes in at least some regions so that its diameter, at least in the region that is currently situated directly in the influence zone of the bottle neck and/or the wiper, decreases as the core is pulled through the wiper and/or the neck of a cosmetic container. Preferably, the core collapses as it passes through the wiper and/or the bottle neck and then opens out again to its original size immediately after passing through the wiper and/or the bottle neck.

In this case, the core is designed so that it collapses even before the forces that the wiper and/or the bottle neck exert(s) on the applicator as it is being pulled out/slid back in become so great that there is a risk of damage to the bristles.

In this way, applicators with a core can be produced that have an enlarged diameter without simultaneously also requiring the production of a new container and/or a new wiper, which must both have a comparably enlarged diameter. In this connection, the claimed embodiment form of the core results in the fact that the applicators according to the invention, on the whole, have a shape that does not deviate decisively from the shape of conventional applicators so that the applicator can be used in the usual way—for example in the case of a mascara applicator, so that the applicator can be held sideways in front of the eye in order for the set of bristles to extend practically along the entire arc of the eyelash.

In a preferred embodiment, the core has at least one arm that is equipped with bristles, protrudes outward from the central region of the core, and is elastic so that it reversibly moves in the direction toward the central body of the core under the influence of the forces exerted by the wiper and/or the bottle neck of the cosmetic container.

An arm of this kind serves to enlarge the bristle field, but lies down against the central body of the core as the applicator passes through the wiper and/or the bottle neck, thus reducing the cross-section of the core that is passing through the wiper and/or the bottle neck.

Ideally, the cosmetic applicator has a core with a U-shaped, C-shaped, S-shaped, or Z-shaped cross-section. Cross-sections of this kind are particularly suitable for collapsing or being compressed in a space-saving way under the influence of the forces that are produced as the applicator is being pulled out through the wiper and/or the bottle neck.

In another preferred embodiment, the core and/or at least one arm is/are composed of a plastic that has a lower hardness and/or higher elasticity than the plastic of the bristles. Ideally, a flexible plastic is used for the core and/or the arm. If different plastics are used here for the core and/or the arm on the one hand and the bristles on the other, then this makes it easy to design the structure so that the arms flex as the applicator passes through the wiper and/or the bottle neck and move so that the core temporarily assumes a smaller cross-sectional area before the forces exerted by the wiper and/or the bottle neck cause damage to the bristles.

In another preferred embodiment, the core is injection molded together with its set of bristles in a single work step out of the same material. An applicator of this kind can be produced very quickly and easily. In such a case, the required flexibility of the arms can be achieved by means of correspondingly thin wall thicknesses at the crucial locations on the arms. In this specific context, it can be advantageous to link the at least one arm to the central region of the core by means of a film hinge. A film hinge forms a defined pivoting point so that the core can easily move in the desired direction. The plastic in the region of the film hinge is also advantageously dimensioned to be thick enough to ensure the required bend recovery capacity, in other words, after lying down against the central region of the core during the passage through the wiper and/or bottle neck, the arm is forced to spring back up into its original position. If necessary, this can be ensured by means of spring elements, for example in the form of one or more spring arms that support(s) the relevant arm on the central region of the core in a flexible fashion.

In another preferred exemplary embodiment, the set of bristles is composed of a different material than the core and/or the arm; preferably, the material has been subsequently injection molded onto the core and/or arm from the outside and thus intimately bonded, preferably "welded," to it.

Preferably, the bristles are composed of a second plastic that is injection molded into the first plastic. Ideally, this ensures a particularly secure anchoring of the bristles to the core and/or arms.

In a preferred embodiment, the cosmetic applicator has a central body that is composed of a tube, which is made of the first plastic and is filled on the inside with the second plastic.

Advantageously, the tube has first openings through which the second plastic that fills the central body reaches, forming bristles on the outside of the tube.

Ideally, the tube has at least one second opening through which the second plastic that fills the tube reaches, forming an arm on the outside of the tube.

It is particularly advantageous if the core has a central body from which a plurality of arms protrude outward, preferably in a star shape so that all of the arms are spaced equidistantly apart from one another in the unstressed state.

In a particularly preferred embodiment, one arm—and preferably each arm—is embodied in the form of a preferably solid and thus essentially torsionally rigid strip that is attached on one side and extends in a direction parallel to the longitudinal axis of the applicator along most—and preferably all—of the central body, not counting the latter's coupling section. In this case, the longitudinal axis of the applicator that has been described in greater detail above preferably extends inside the solid central body, (provided that the applicator according to the invention is not alternatively designed by being embodied in the form of a slotted tube that is intrinsically closed in the circumference direction except for a single slot that is preferably parallel to the central longitudinal axis.

Protection is also claimed for a system composed of an applicator of the above-described type, a cosmetic container, and a wiper fastened thereto, which is distinguished by the fact that the wiper and the applicator are matched to each other so that the applicator collapses as it is being pulled and/or pushed through.

BRIEF DESCRIPTION OF THE DRAWINGS

Other advantages, embodiment possibilities, and functions of the invention ensue from the following exemplary embodiments described in conjunction with the drawings.

DETAILED DESCRIPTION OF THE PREFERRED EMBODIMENTS

Figure 1:
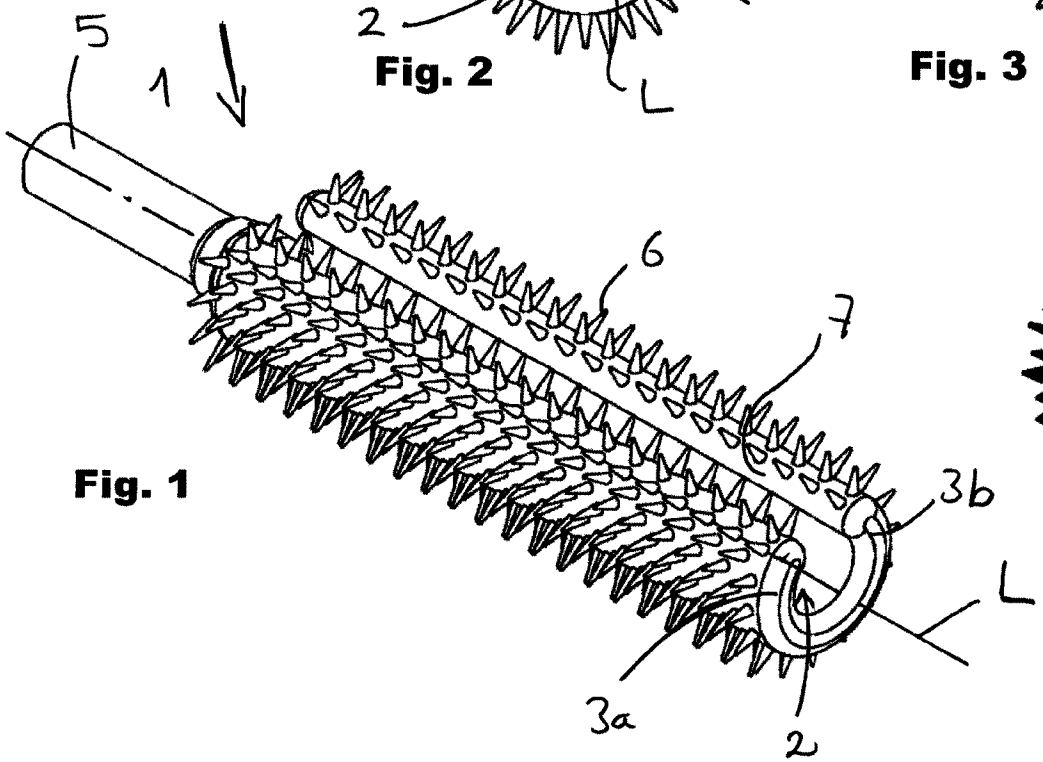
FIG. 1 shows a perspective view of a first exemplary embodiment of the invention in which the bristle support is embodied in the form of a slotted tube.

The first exemplary embodiment of the invention in which the core is embodied in the form of a slotted tube can be explained most clearly with reference to FIG. 1.

The applicator 1 includes a coupling section 5 for the attachment of a handle and/or wand and a core 2 whose outer circumference surface is equipped with bristles 6 that are preferably injection molded. Usually, these bristles protrude out essentially in the radial direction.

Preferably, the edge surfaces 7 of the tube that rim the slot 4, which will be explained in greater detail below and which interrupts the circumference surface of the tube, are also equipped with bristles 6. Ideally, a plurality of rows of bristles positioned one behind another in the longitudinal direction are mounted on each of the above-mentioned edge surfaces 7. The bristles of at least one of the above-mentioned bristle rows on the respective edge surface 7 advantageously protrude into the region of the slot 4, ideally so that despite the presence of the slot 4, a bristle field is produced that is essentially intrinsically closed in the circumference direction.

Figure 3:
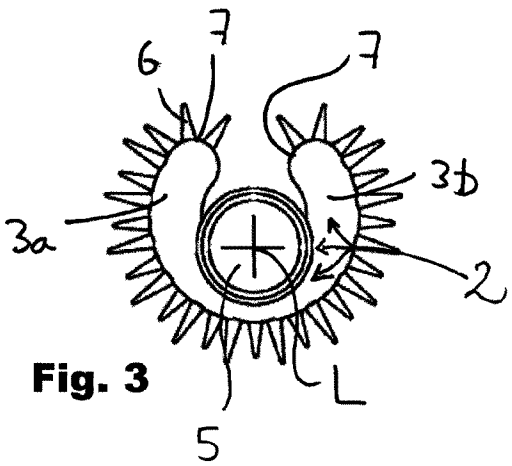
FIG. 3 shows the first exemplary embodiment of the invention from the proximal end.
Figure 2:
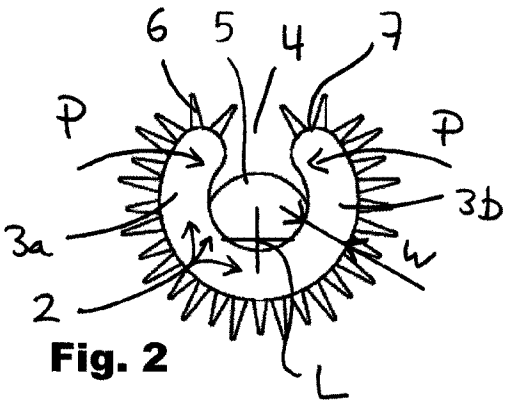
FIG. 2 shows the first exemplary embodiment of the invention from the distal end, i.e. the end oriented away from the wand.
Figure 4:
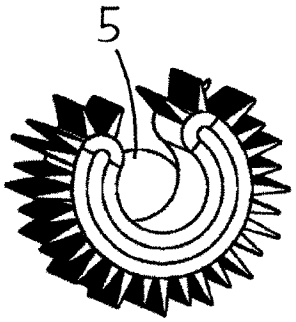
FIG. 4 shows a view of the first exemplary embodiment in an oblique frontal view from the distal end.

Ideally, the edge surfaces 7 are rounded. FIG. 3 shows this. The curvature radius of the rounding ideally corresponds approximately to half the wall thickness of the tube that forms the core.

The core 2 is connected at one end to the wand of the applicator or more specifically to the coupling section 5 that is provided on the wand for this attachment.

Ideally along the entire core, the bristles 6 form rows of bristles that are positioned one behind another in a line extending in the direction of the central longitudinal axis L and simultaneously rows of bristles that are positioned one behind another in a line extending in the circumference direction. Each bristle is preferably slightly conical, the straight lines laid against its circumferential surface together with the longitudinal axis LB preferably enclose an angle $\alpha$ of between 0.5° and 3°, see FIG. 4*a*.

Figure 4B:
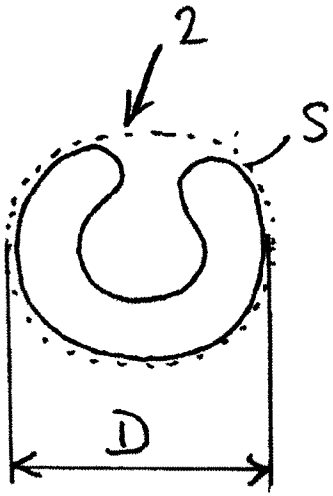
FIG. 4*b* shows the core embodied in the form of a slotted tube that is used in the first exemplary embodiment of the invention, in the non-deformed state.
Figure 4C:
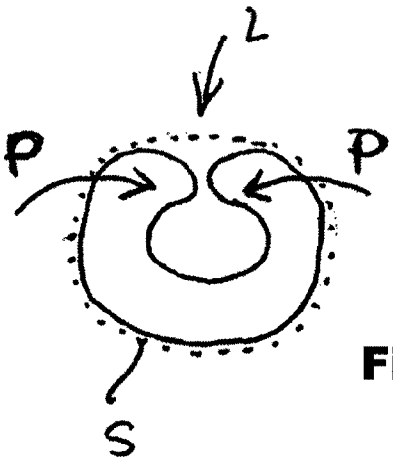
FIG. 4*c* shows the core embodied in the form of a slotted tube that is used in the first exemplary embodiment of the invention, in the deformed state.
Figure 4A:
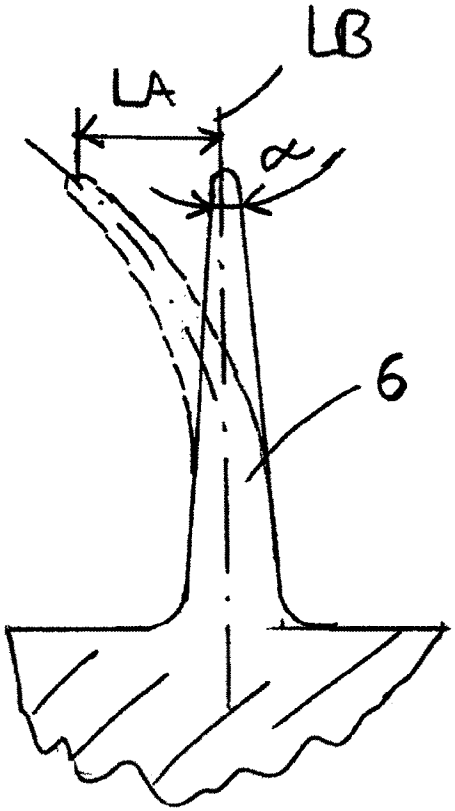
FIG. 4*a* shows details of the bristles that are preferably used for the invention.
Figure 5:
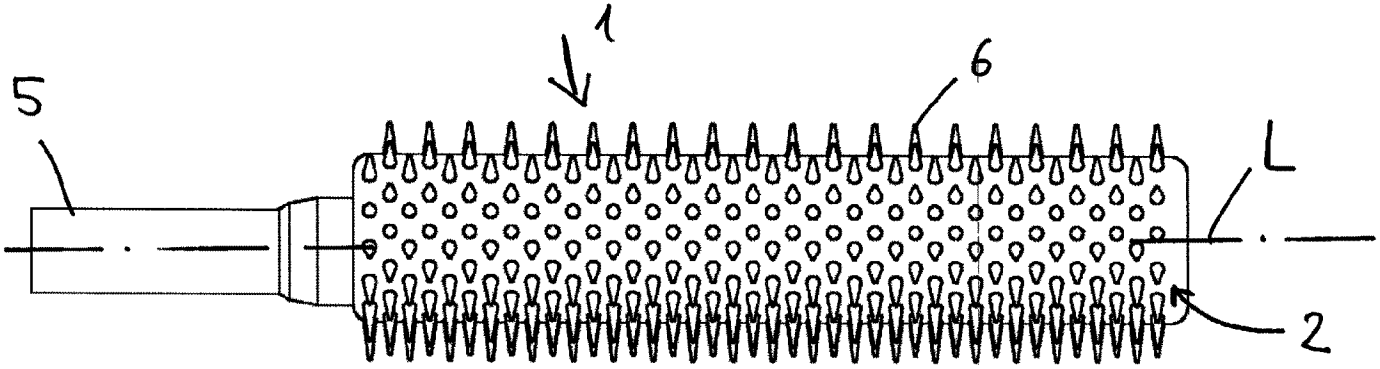
FIG. 5 shows the first exemplary embodiment of the invention, viewed from below.
Figure 6:
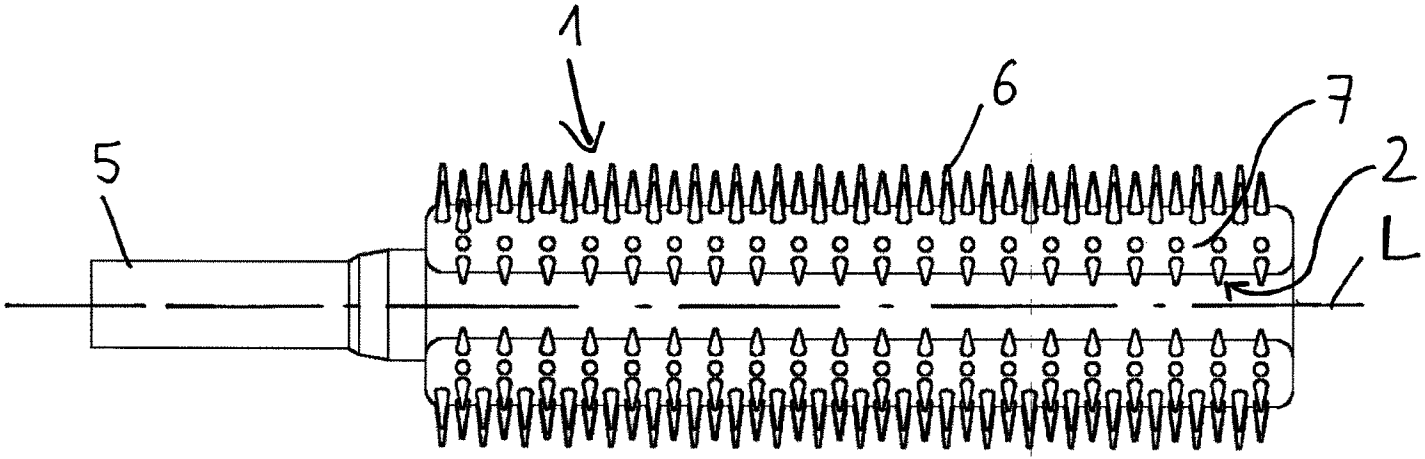
FIG. 6 shows the first exemplary embodiment of the invention, viewed from above.

Preferably, every bristle is flexible enough that its tip can be reversibly deflected by a distance LA that is preferably at least 4 times—better still, at least 6 times—the maximum bristle diameter, measured above the rounded section via which the base of the bristle transitions into the core, also see FIG. 4*a*.

Unlike in the known applicators, the core 2 of the applicator according to the invention is preferably not embodied as so solid that as it passes through the wiper and/or the bottle neck, it is not subject to any visible deformations.

In lieu of this, the core in this exemplary embodiment is embodied in the form of a tube that is hollow on the inside and has a continuous slot at its circumference, extending along its entire length. It is advantageous if in the circumference direction, the slot occupies approximately ⅛ to ¼ of the circumference of the tube, if one imagines a corresponding complete tube that is intrinsically closed.

Preferably, the tube has the cross-section of a slotted annular cylinder since this is the simplest way to ensure a uniform density of the set of bristles. The alternative, providing the tube with the cross-section of a slotted polygonal ring, for example of a hollow hexagon or octagon, however, is also within the scope of what is claimed in the invention, even though the annular cylindrical tube is preferred. For many applications, it is best if the tube has the cross-section of a slotted annular cylinder since this is the simplest way to ensure a uniform density of the set of bristles. A cross-section that has the shape of a slotted polygonal ring comes close to this, for example a slotted octagon that is hollow on the inside.

For other applications, one alternative can be to provide the tube with the cross-section of a slotted ellipse that is hollow on the inside, a slotted oval that is hollow on the inside, or a U-shaped or V-shaped cross-section. In this way it is easy to produce an applicator with a bristle set density that changes in its circumference direction so that the applicator has different application properties depending on the rotary position in which it is brought into contact with the location to be treated. In all of this, however, the circular cross-section of the slotted tube remains the clearly preferred embodiment.

The interior of the tube that is open to the outside by means of the slot that is preferably provided on only one side of the circumference generally forms a trough that accommodates a certain quantity of the cosmetic to be applied. Preferably, the tube is also open at its distal end, i.e. the end oriented away from the wand and/or the coupling section 5, so as not to prevent the deformation of the tube in the vicinity of the distal end. In most cases, the coupling section 5 is only fastened to the tube along a part of the latter's circumference so that the deformation of the tube in the region of the proximal end is not hindered or at least, not significantly.

The wall thickness of the entire tube and/or of the regions of the tube that are intended for the deformation—which are the sections of the tube that are not themselves directly attached to the coupling section 5 and therefore flexibly protrude from the central body 8 that is attached to the coupling section 5 and constitutes the spine—is selected so that the two arms 3*a* and 3*b* that border the slot 4 can move toward each other in the direction of the arrows P so that the diameter of the core and therefore also the cross-sectional area Q occupied by the core decreases, see FIGS. 4*b* and 4*c*, which provide only schematic depictions of the core, without depicting the set of bristles. The cross-sectional area Q occupied by the core is understood to mean the area encompassed by the imaginary rope line of a rope that is wrapped around the outside of the core, once again see FIGS. 4*b* and 4*c*. According to the invention, the wall thickness and the material of the core are selected so that the above-described movement of the arms occurs automatically under the influence of the forces that the wiper and/or the neck of the container exert on the core as soon as the core is pulled out as intended through the wiper and/or the bottle neck or is slid back into the container in the opposite direction. In so doing, the arms 3*a* and 3*b* are not deformed over their entire length. Instead, they are in most cases only deformed where they are directly subjected to the compressively acting forces of the wiper and/or bottle neck.

Figure 30:
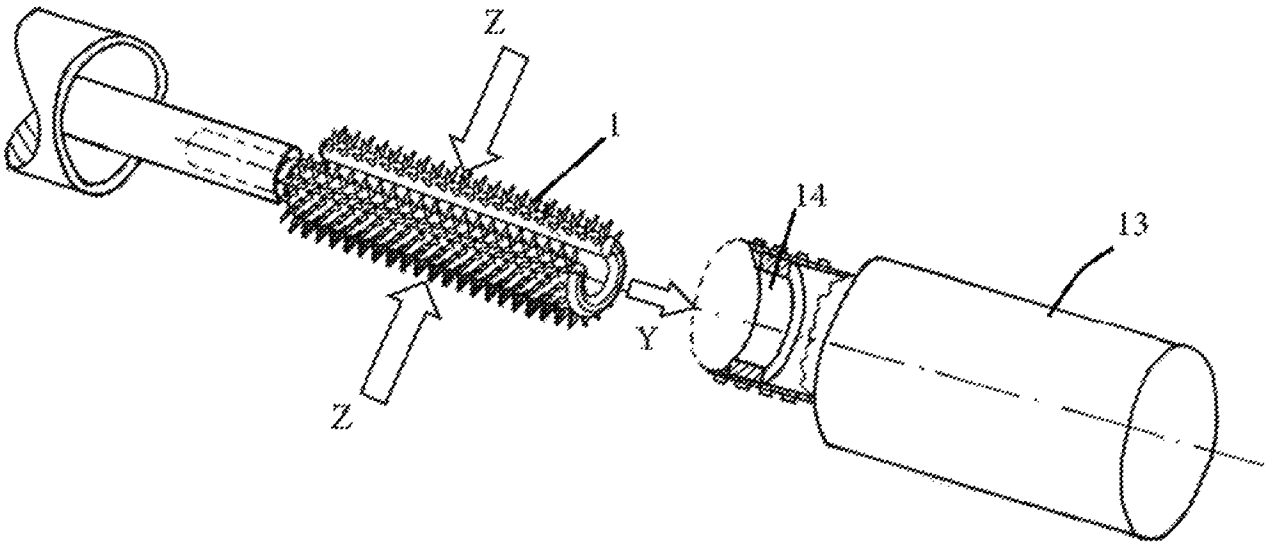
FIG. 30 shows a cosmetic container associated with an embodiment of the invention.

FIG. 30 shows a cosmetic container 13 with half of a threaded bottle neck broken away to show a wiper 14 within the cosmetic container 13, The arrows Z its FIG. 30 illustrate the deformation forces that act on the applicator 1 when the applicator 1 is pulled through the wiper 14 in the direction illustrated by the smaller arrow Y as well as in the opposite direction.

It is thus possible to produce an applicator, which, when ready for application, has a core 2 with an exceptionally large core diameter D, where preferably D>3.5 mm; ideally, D≥4.5 mm. Despite the exceptionally large core diameter D, in many cases, it is not necessary to use cosmetic containers with a particularly wide bottle neck and/or wiper with a particularly large inner diameter for the applicator. This is because the core 2 "collapses" or "rolls up" as it passes through the wiper and/or the bottle neck and therefore at this moment, behaves like a core with a smaller core diameter L.

Ideally, the tube has an at least essentially constant wall thickness, at least in the circumference direction, but preferably throughout, which is selected so that the whole tube forms a spring in the circumference direction. This is the easiest way to ensure a powerful spring action without having to embody the regions of the tube with such thin walls that there is a risk of an undesirable spring action occurring during application. A dimensionally stable application is assured as before.

It should be noted that the invention does not concern the insignificant deformations that inevitably occur as small or micro-deformations whenever one body exerts forces on the other. The invention instead concerns deformations that are accompanied by a clearly perceptible effect, preferably the deformations that reduce the cross-sectional area Q of the core by at least 10% and better still by at least 20%.

In all of this, the bristles and the core are matched to each other. The core is designed so that it flexes even before the forces—which are produced during the passage through the wiper and/or the bottle neck—become great enough to bend the bristles over so sharply that they are damaged. There is no mathematically universal formula for meeting this condition. Instead, a manageable number of tests that are customary in the field, possibly supported by FEM calculations, must be carried out in order to ensure that the individual core is embodied so that when it is equipped with specifically provided bristles, it cooperates with a particular wiper and/or a particular bottle neck in the spirit of the above-described condition. In all of this, it is naturally necessary to take into account the fact that the applicators according to the invention are most often single-use items, solely for hygiene reasons. In light of this, it can be sufficient where applicable if the bristles do not suffer any visible damage during the intended duration of use provided.

It can be advantageous to injection mold the core 2 out of a more elastic first plastic and to injection mold the bristles out of a second plastic that is more rigid by comparison. In some cases, it is particularly advantageous if the first plastic is a flexible or rubber-elastic plastic. A core that is at least predominantly composed of such plastic can be deformed in the way according to the invention as it passes through the wiper and/or the bottle neck, even by comparatively slight forces. This enables to "go easy on" the bristles—because even before the forces—which are produced during the passage through the wiper and/or the bottle neck—reach the critical point for the bristles, the core flexes.

Alternatively to the one-material/one-piece production of such an applicator, in a multiple-material embodiment, it is also possible for a core to be injection molded first, for example a core with a C-shaped cross-section in the region of the subsequent set of bristles. In a second injection molding step, a second plastic is injection molded onto the outside of the C-shaped core. This plastic forms the bristles. Preferably, the second plastic envelops the core composed of the first plastic essentially completely. With a corresponding selection of the method parameters, the first and second plastics are completely welded to each other. It is not possible to provide a generally applicable recipe for how to select the method parameters so that such a welding occurs because these parameters are very dependent on the individual case; the method parameters to be established in the specific case can, however, be determined by tests that are customary in the field once the important factors are known.

As indicated above, the applicator according to the invention can naturally also be composed of a single material and produced in a single injection molding step. It is then necessary to ensure that the core is embodied with thin enough walls so that even if a flexible plastic is not used for it, the spring action according to the invention is exhibited; in this case, the wall thickness must then be embodied so that the core does not snap under any circumstances, even when it is under the maximum amount of stress and is thus in future partially or entirely robbed of its spring action.

Figure 28:
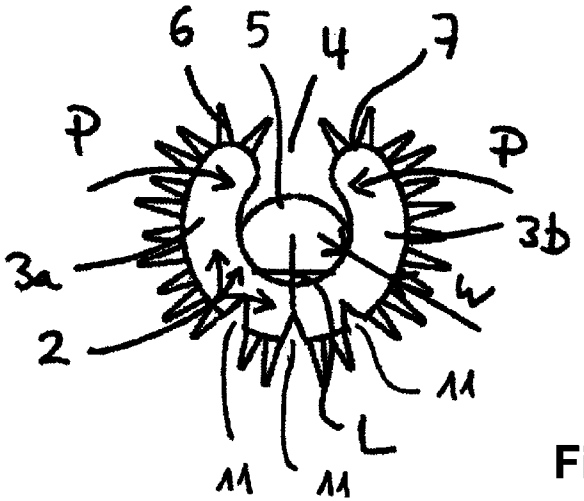
FIG. 28 shows a modification of the first exemplary embodiment according to FIGS. 1 through 6.
Figure 29:
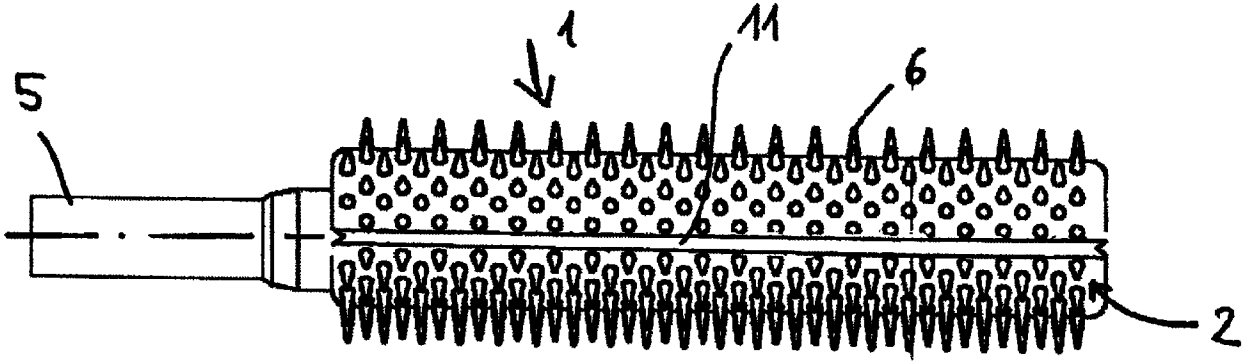
FIG. 29 likewise shows a modification of the first exemplary embodiment according to FIGS. 1 through 6.

In order to improve the spring action, it can be useful to provide the tubular core with one or more thin places extending essentially continuously in the direction of the longitudinal axis, which preferably form a hinge-like region as shown in FIGS. 28 and 29.

Figures 7, 8, 9, 10:
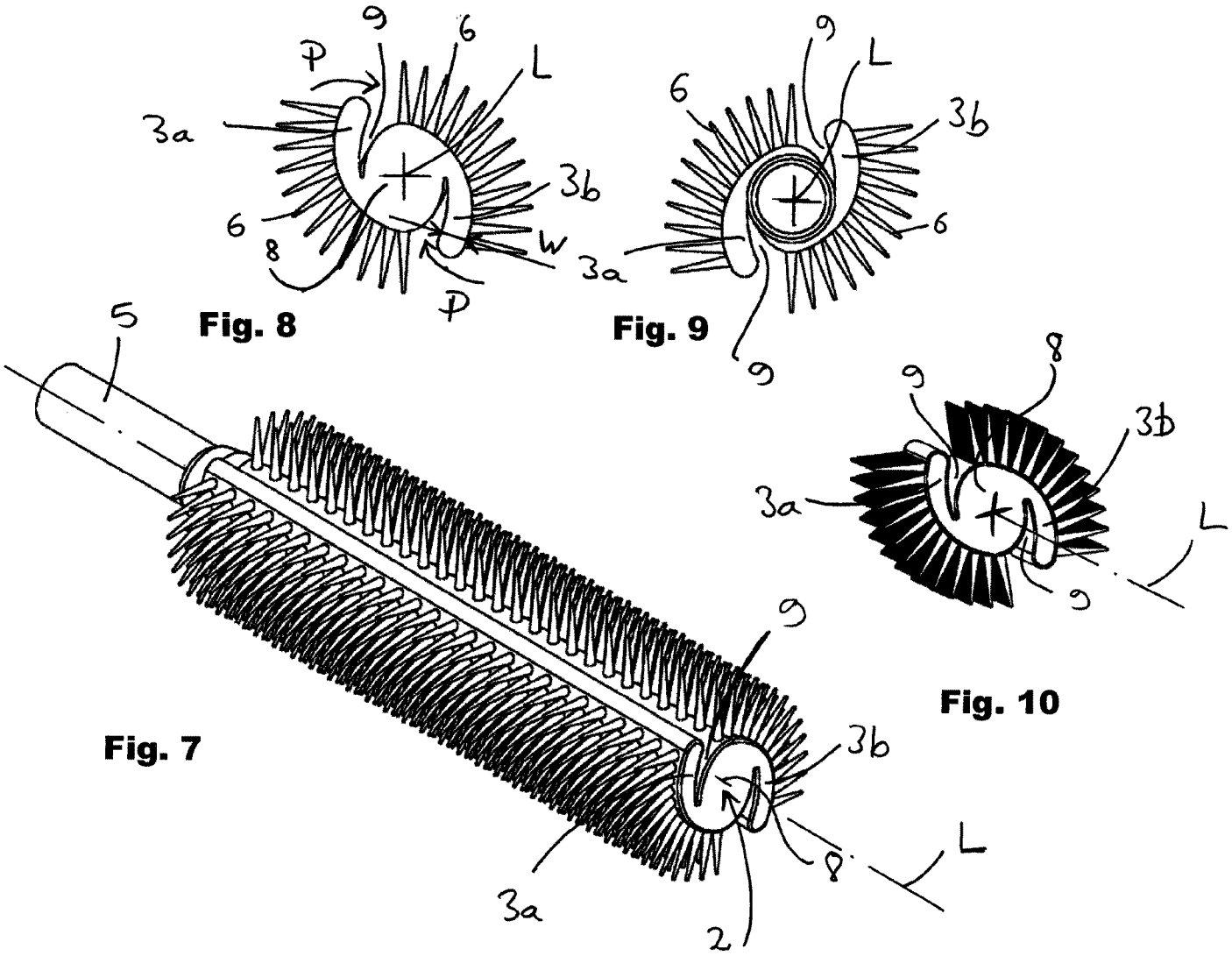
FIG. 7 shows a second exemplary embodiment of the invention that has a solid core with mobile arms protruding from it, in a perspective view obliquely from the front.
FIG. 8 shows the second exemplary embodiment of the invention from the distal end.
FIG. 9 shows the second exemplary embodiment of the invention from the proximal end.
FIG. 10 shows a perspective view of the second exemplary embodiment of the invention in a slightly oblique view from the front; the individual bristles that are positioned one behind another in the direction of the longitudinal axis are not shown in detail in this drawing.
Figure 11:
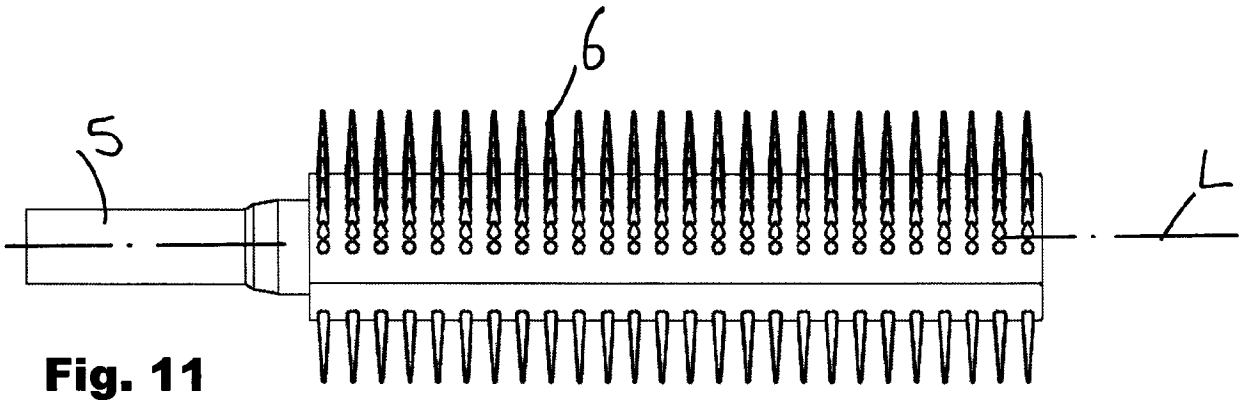
FIG. 11 shows the second exemplary embodiment of the invention, viewed from below.
Figure 12:
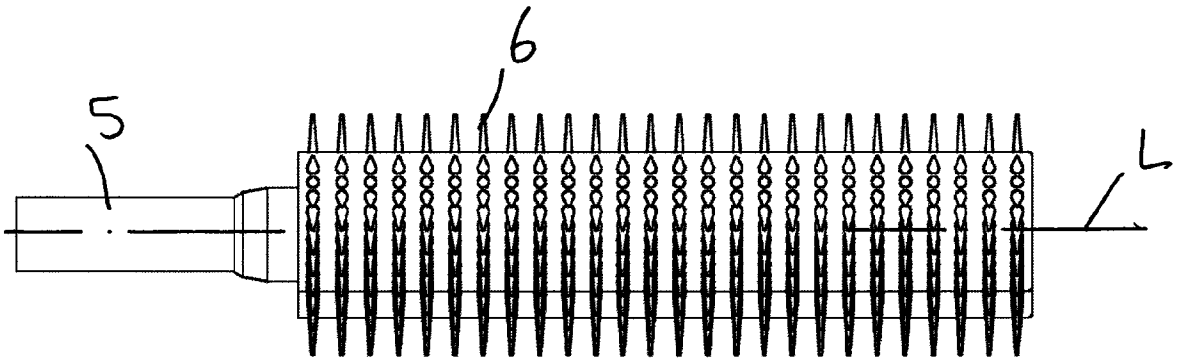
FIG. 12 shows the second exemplary embodiment of the invention, viewed from the side.
Figure 15:
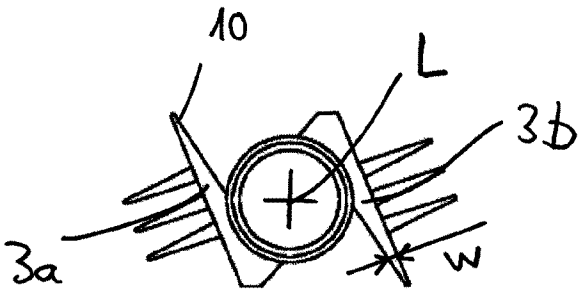
FIG. 15 shows the third exemplary embodiment of the invention, viewed from the proximal end.
Figure 14:
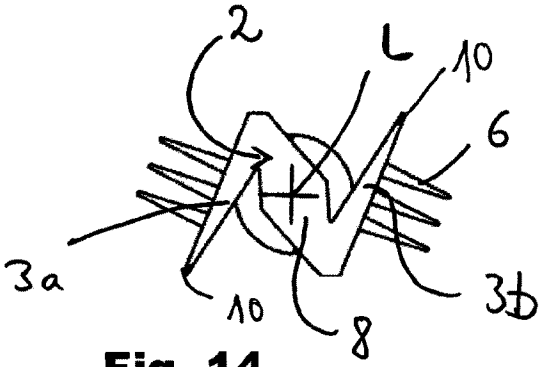
FIG. 14 shows the third exemplary embodiment of the invention, viewed from the distal end.

The second exemplary embodiment of the invention can best be explained in conjunction with FIG. 7. That which has been said in relation to the first exemplary embodiment likewise applies to this exemplary embodiment, provided that nothing to the contrary ensues from the different cross-sectional shape of the core in this exemplary embodiment. Finally, the above explanations regarding the type of bristle set, the embodiment of the bristles, and the production of the core and its bristles, as well as the explanations regarding the matching of the bristles to the core are applicable to this exemplary embodiment as well.

In this exemplary embodiment, the core 2 is composed of an essentially non-deformable central body 8 and a plurality of arms 3*a*, 3*b* protruding outward from it, preferably two of them. The arms extend in the direction of the longitudinal axis of the applicator L, preferably across the entire applicator region, i.e. across the entire region that is equipped with bristles. Each of the arms is only connected to the central section 8 at one end and therefore protrudes from the central section like a cantilever beam or wing. The arms themselves have no direct connection to the coupling section 5 since such a direct connection would hinder their mobility. The arms and the central section form a V-shaped, acute-angled gap 9 in which the cosmetic compound can be stored, which can be partially pushed out when the applicator is pulled out through the wiper and/or the bottle neck and is then available in the vicinity of the set of bristles.

Each of the arms 3*a*, 3*b* has a set of bristles on its outside.

It is particularly preferable for the arms 3*a*, 3*b* and the central section 8 of the core 2 to form an S-shaped cross-section. Ideally, this is distinguished by the fact that the arms 3, 3*b* and the central section transition into one another smoothly on the outside and together, constitute a convex outer surface that is continuously equipped with bristles. In this way, both the central section 8 and the arms 3*a*, 3*b* have bristles 6. Consequently, a particularly large field of bristles is provided, which significantly improves the application properties of the applicator.

The arms 3*a*, 3*b* are embodied as intrinsically elastic on the whole and/or as elastically linked to the central section 8 in such a way that the arms 3*a*, 3*b* can move in the direction of the arrows P, in other words in the direction toward the central section 8 of the core 2 so that the diameter of the core and therefore also the cross-sectional area Q occupied by the core decreases on the whole, see FIG. 8, whose arrows P indicate this situation. The cross-sectional area Q occupied by the core is understood to mean the area encompassed by the imaginary rope line of a rope that is wrapped around the outside of the core. According to the invention, the wall thickness, the material, and/or the attachment of the arms 3*a*, 3*b* to the central region are selected so that the above-described movement of the arms occurs by itself under the influence of the forces that the wiper and/or the neck of the container exert(s) on the core as soon as the core is pulled out as intended through the wiper and/or the bottle neck or is slide back into the container in the opposite direction.

In many cases, the arms have an essentially constant wall thickness throughout.

As has already been touched upon above, in other cases, arms are used that owe a significant part of their mobility to the fact that they are attached to the central section 8 in a mobile fashion—for example with the aid of a hinge, ideally with the aid of a film hinge or by means of a strip of flexible plastic that constitutes an intermediate piece.

In the exemplary embodiment shown in particular in FIGS. 7 and 8, a middle-path solution has been selected. In this case, the arms are not in fact attached to the central section 8 by means of a hinge, but instead, their wall thickness decreases in the direction toward the central section so that they are embodied to be the most elastically flexible in the region of the maximum bending moment.

Figure 13:
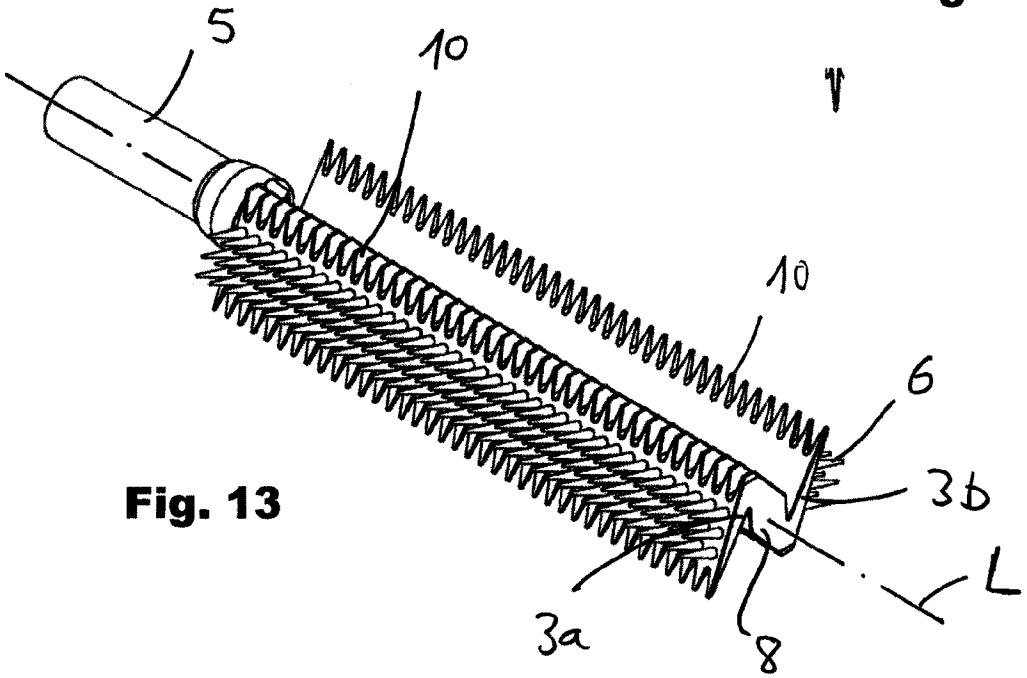
FIG. 13 shows a perspective view of the third exemplary embodiment of the invention, viewed obliquely from the front.
Figure 16:
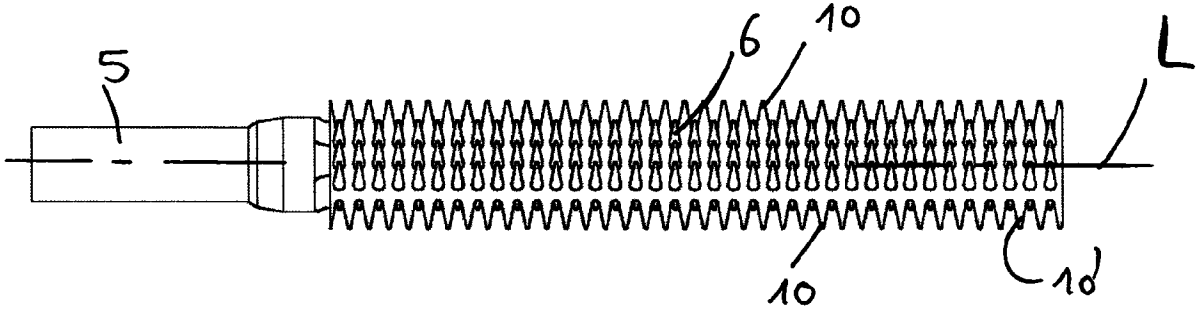
FIG. 16 shows the third exemplary embodiment, viewed from the side.
Figure 17:
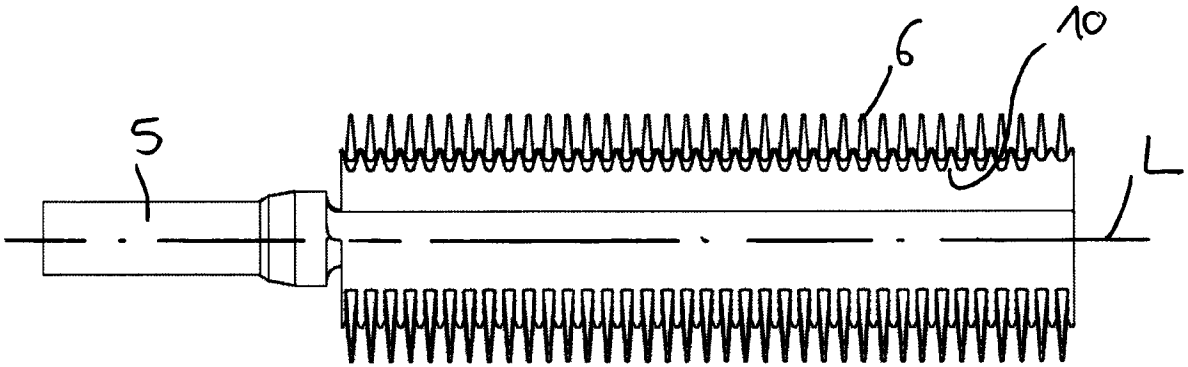
FIG. 17 shows the third exemplary embodiment, viewed from below.

The third exemplary embodiment of the invention can best be explained with reference to FIG. 13. That which has been said in relation to the first exemplary embodiment and that which has been said in relation to the second exemplary embodiment regarding the attachment of the arms to the central region of the core are likewise applicable to this exemplary embodiment, provided that nothing to the contrary ensues from the different cross-sectional form of the core in this exemplary embodiment. Finally, the above explanations regarding the type of bristle set, the embodiment of the bristles, and the production of the core and its bristles, as well as the explanations regarding the matching of the bristles to the core are also applicable to this exemplary embodiment.

In this exemplary embodiment as well, the core 2 is composed of an essentially non-deformable central section 8 and a plurality of arms 3*a*, 3*b* protruding outward from it, preferably two of them. Once again, the arms extend in the direction of the longitudinal axis of the applicator L, preferably across the entire applicator region, i.e. across the entire region that is equipped with bristles. The arms themselves have no direct connection to the coupling section 5 since such a direct connection would hinder their mobility.

Each of the arms 3*a*, 3*b* has a set of bristles on its outside. Preferably, on the outside from which the bristles 6 protrude, each of the arms is flat or only slightly curved, with a curvature radius R>10 mm or better still, R>25 mm.

In this way, it is possible to provide two separate flat or only slightly curved bristle fields, which make it possible to achieve outstanding application and/or combing properties. The description given at the beginning is applicable with regard to the bristle arrangement of the bristle fields.

Particularly preferably, the arms 3*a*, 3*b* and the central section 8 of the core 2 form a Z-shaped cross-section.

Although not absolutely required, the scope of this exemplary embodiment also includes embodying the arms so that their thickness Di is the greatest in the vicinity of their transition into the central section 8 and decreases toward its free end. The flexibility of the arms that is required according to the invention is ensured in that their thickness D1 in absolute terms is selected to be thin enough and/or in that an appropriately easily-to-deform plastic material is used for the arms. Here once again, it is necessary to alternatively consider the attachment of the arms 3*a*, 3*b* to the central region with the aid of a hinge, in particular a film hinge, which is not shown in the drawings. In this exemplary embodiment, the arms 3*a*, 3*b* are ideally provided with tines 10 in the region in which they transition into the central body 8 and these tines form a comb that is used, for example, to separate the lashes after the application of the mascara. The comb tines are distinguished from the bristles by the fact that they are less flexible and even behave in a rigid fashion when subjected to the forces that occur during the intended application. The tines 10 can best be seen in FIG. 13.

Preferably, each arm has comb tines 10' at its free end viewed in the circumference direction, which are positioned in a row and thus form a comb. These comb tines can be provided in addition or as an alternative to the above-mentioned comb tines.

Protection is also claimed for the use of the cosmetic applicators, which are described in this description and in the associated claims, as mascara applicators whose bristle field has a maximum span of 30 mm in the direction of the longitudinal axis L and a maximum outer diameter of 15 mm or better still, only 12 mm.

Finally, it should be noted that regardless of the asserted claims, in quite general terms, protection is also claimed for an applicator with a core and bristles protruding therefrom in which the core is elastic in at least some regions so that the cross-sectional area occupied by the core reversibly decreases when passing through the wiper and/or the bottle neck of the cosmetic container associated with the cosmetic applicator under the influence of the forces exerted by the wiper and/or the bottle neck.

Before descriptions of other variants or exemplary embodiments are given below, it should be generally noted with regard to all of the applicators disclosed by this specification that the applicators according to the invention are preferably used as mascara applicators. Their outer dimensions are therefore correspondingly small and usually amount to 15 to 30 mm—at most 40 mm—in the direction of the longitudinal axis of the applicator. The maximum diameter is generally less than 20 mm.

Figure 18:
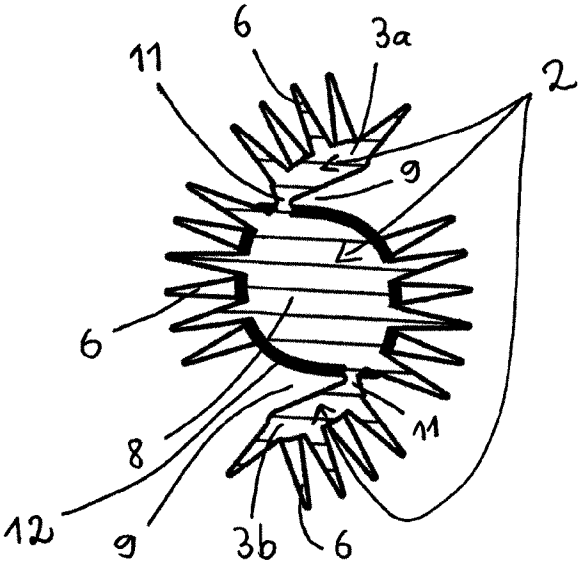
FIG. 18 shows a fourth exemplary embodiment of the applicator according to the invention in the section A-A indicated in FIG. 19.

The precise embodiment of another exemplary embodiment of an applicator according to the invention can best be seen in FIG. 18.

First of all, this exemplary embodiment and the other exemplary embodiments that are described below do not absolutely have to be embodied so that the cross-sectional area occupied by the core reversibly decreases as it passes through the wiper and/or the bottle neck under the influence of the forces exerted by the wiper and/or bottle neck—even such an embodiment of the applicator or of the likewise claimed overall system composed of the applicator, container, and wiper is advantageous and is therefore present in most cases.

Figure 19:
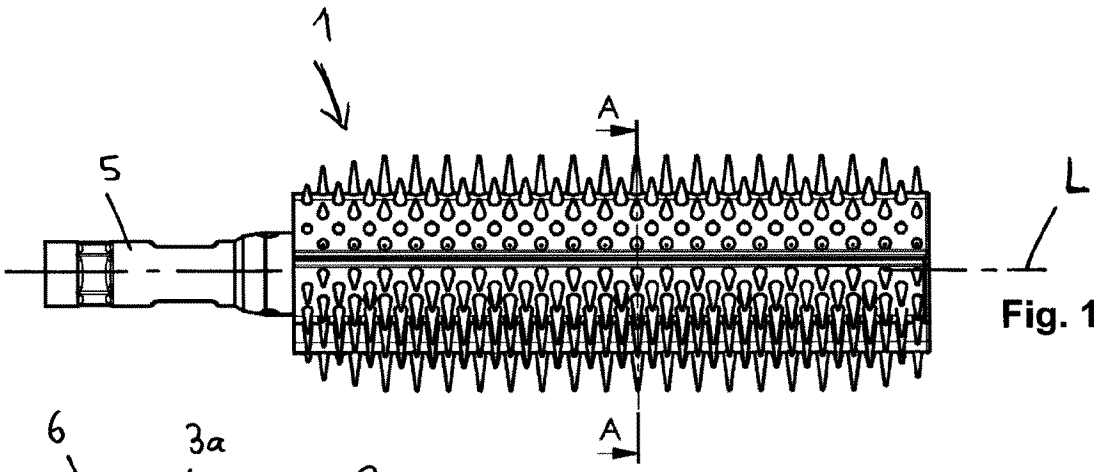
FIG. 19 shows a side view of the fourth exemplary embodiment.
Figure 20:
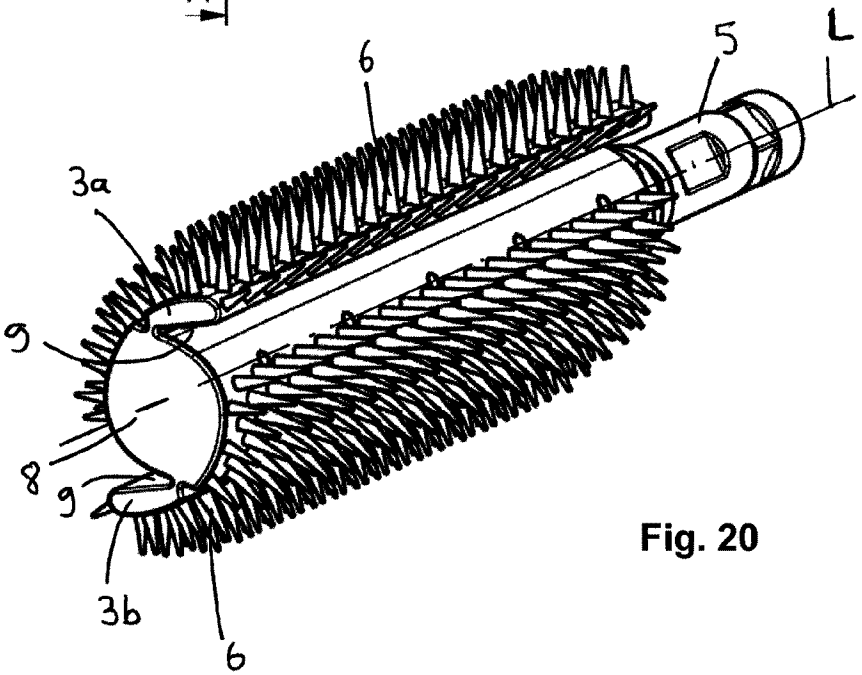
FIG. 20 shows a perspective view of the fourth exemplary embodiment obliquely from the front.

The applicator 1 comprising this exemplary embodiment is composed of a core 2, which most of the time, transitions into a coupling piece 5 (see FIGS. 19 and 20), which serves to attach the applicator to a wand that is not shown. The wand in turn transitions into a handle that is likewise not shown.

The core 2 in this case is composed of a central body 8 that is essentially not deformable or only marginally deformable under the influence of the forces that usually occur in the application and is usually embodied in the form of a solid cross-section. This constitutes the spine of the applicator, so to speak, and preferably extends along the entire—or at least most of the—length of the set of bristles parallel to the longitudinal axis L of the applicator as defined above.

Bristles protrude from the outer circumference of the central body 8 so that the central body 8 constitutes a brush all by itself. In addition, the core is composed of at least one arm 3*a*, 3*b*—or better still, a plurality of them—protruding out from the central body 8. Preferably, each of the arms is embodied so that it also constitutes a brush, i.e. has a plurality of bristles. The cross-sectional area of the central body 8 perpendicular to the longitudinal axis L of the applicator is greater than the corresponding cross-sectional area of an arm 3*a*, 3*b*, preferably at least by a factor of 3. The central body 8 preferably makes up most of the applicator 1; the arms 3*a*, 3*b* are then only an appendage of the central body 8.

Each of the arms 3*a*, 3*b* can be intrinsically elastic so that as a whole, it constitutes a kind of leaf spring that is stressed on one side and is correspondingly mobile for this reason alone.

It is, however, preferable for each arm 3*a*, 3*b* to be attached as a whole to the central body 8 in a movable fashion with the aid of a thin part 11 or with the aid of a film hinge. The attachment is preferably embodied so that the respective arm 3*a*, 3*b* is able to move virtually as a unit in the direction of the arrow P, in other words in the direction toward the central body 8, i.e. the core 2, (see FIG. 21). In this case, this movement occurs essentially through rotation around the thin part 11. By means of this, the diameter of the core (and therefore also the cross-sectional area Q on the whole that is occupied by the core) can decrease in a particularly effective fashion, which becomes clear with a direct comparison of FIGS. 21 and 22, which do in fact show another exemplary embodiment that will be described in greater detail below, but the mobility of this other exemplary embodiment is identical to that of the exemplary embodiment in question here. The cross-sectional area Q occupied by the core is understood to mean the area encompassed by the imaginary rope line of a rope that is wrapped around the outside of the core, bypassing the bristles.

As can be seen the clearest in FIG. 18, the central body 8 in this first exemplary embodiment is composed of a tube 12, which is colored black in the cross-section shown in FIG. 18.

The tube 12 is composed of a first plastic material and is at first hollow in the production sequence of the applicator. The tube 12 is filled by the second plastic material, which is injected into the tube during production. The two plastic materials are welded in the places where they come into contact with each other. Preferably, the second plastic material is more flexible, or more elastic than the first plastic material.

The production is preferably carried out in such a way that the tube 12 is first produced with a completely closed tube casing.

For the next injection molding step, the tube 12 is placed in an injection mold. This is composed of a multitude of first mold cavities on the outer circumference of the tube 12 and for each arm that is to be produced, a second mold cavity that forms the respective arm 3*a*, 3*b* and its bristles 6.

If the second plastic compound is now injection molded at high pressure (generally greater than 500 bar, preferably greater than 1,000 bar) into the interior of the tube 12, then the second plastic compound fills the interior of the tube 12. Then the path is cleared through the tube wall into the first and second mold cavities located on the outside, on the other side of the wall. As a result, bristles 6 that preferably protrude outward in an essentially radial fashion are formed out of the second plastic on the outer circumference of the tube 12. In the same way, the arm or arms 3 is/are formed along with the multitude of bristles 6 protruding out from them, which are likewise composed of the second plastic. This is likewise visible in FIG. 18, which in the case of the bristles 6 that lie in the plane of the drawing, shows how the wall of the tube 12 has been locally pierced in each instance. FIG. 18 also clearly shows the fact that the wall of the tube 12 has been pierced at the locations in which the arms 3*a* and 3*b* are attached.

In the course of the production carried out in this way, the tube 12 is thus provided with first openings, by means of which the bristles are connected to the plastic body that fills the interior of the tube 12. In the same way, for each arm, the tube 12 is provided with at least one second opening via which the arm 3*a* or 3*b* is connected to the plastic body that fills the interior of the tube 12.

As a modification that of course does not go beyond the scope of the concept of the invention, the tube 12 can also be provided with the above-mentioned the second opening or openings from the outset so that it is not necessary to rely on the second plastic compound to clear the path through the wall of the tube all by itself in order to enable the injection into the cavity that forms the wing.

In a very simple way, the tube 12 composed of the first, stronger plastic gives the applicator the necessary resistance force against bending moments that act around the longitudinal axis of the applicator in such a way as to cause the central body 8 of the core to bend like a rod. The second, less strong plastic gives the bristles 6 and the at least one arm their required flexibility.

Preferably, the arms 3*a*, 3*b* are each embodied in a strip-shaped form that is usually composed of two large side surfaces, two small side surfaces, and two even smaller edge surfaces; each arm is attached to the central body 8 along one of the two small side surfaces of the arm or an edge between a small side surface and a large side surface of the arm. In other words, each arm can be said to protrude like a wing from the central section, with the wing and the central section extending parallel next to each other.

The cross-section of an arm 3*a* or 3*b* perpendicular to the longitudinal axis L of the applicator is preferably rectangular or wedge-shaped so that the arm tapers toward its narrow side oriented away from the central section.

In the exemplary embodiment described here, the arms 3*a*, 3*b* are preferably essentially rigid aside from their thin part 11.

The arms 3*a*, 3*b* extend in the direction of the longitudinal axis L of the applicator, preferably over the entire region of the applicator, i.e. over the entire region that is equipped with bristles.

Preferably, the bristles are positioned on the side of the arm oriented away from the central body 8 so that their bristle axes diverge in a plane perpendicular to the longitudinal axis L of the applicator. Consequently, the bristle tips of adjacent bristles are further apart than the bases of the bristles. Ideally, the small side surface, which is diametrically opposite from the side surface via which or along which the arm is attached to the central body 8, is equipped with a set of bristles or is embodied in the form of a comb.

The arms 3*a*, 3*b* themselves have no direct connection to the coupling section 5 since such a direct connection would hinder their mobility.

The arms 3*a*, 3*b* and the central body 8 form a V-shaped, acute-angled gap 9 in which the cosmetic compound can be stored, which can be partially pushed out when the applicator is pulled out through the wiper and/or the bottle neck and is then available in the vicinity of the set of bristles.

Preferably, the outside of the central body 8 supports at least 80 bristles 6. Each of the arms has a set of bristles on its outside composed of a plurality of bristles 6, namely ideally at least 40 bristles.

The central section perpendicular to the longitudinal axis of the applicator can have a round—or better still, polygonal—cross-section. Its cooperation with the arms, however, is the most effective if it has a lemon-like cross-section, ideally so that when powerful forces occur, each arm can simply lie down against an only slightly curved or even straight circumference section of the central body 8, which section does not as a rule have bristles itself. For the sake of completeness, it should be noted that it is alternatively also possible to injection mold a central body first and then, in a second step, to injection mold onto the central body the bristles that are fastened directly to it and/or to injection mold the bristles onto the arms so that the (preferably different) plastic compound (that is used for this) is welded to that of the central body.

Figure 22:
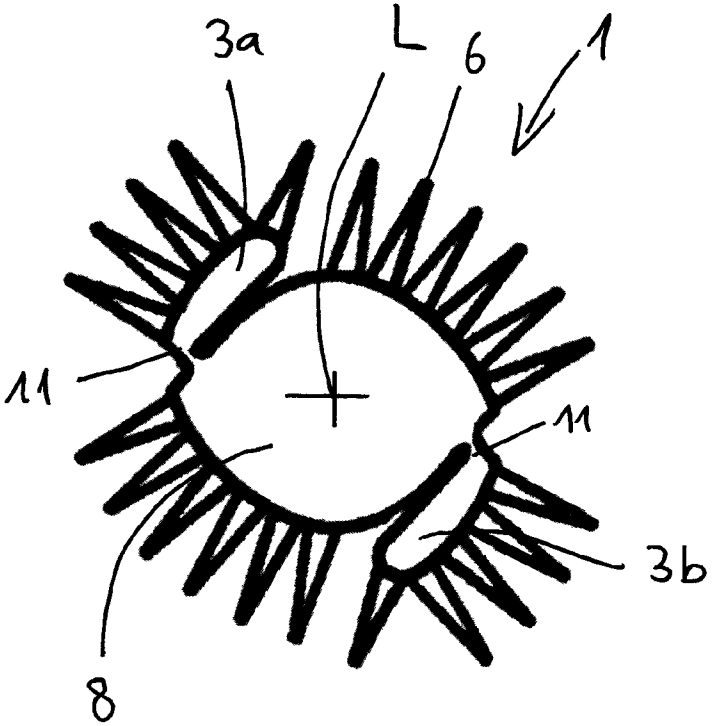
FIG. 22 shows a front view of a fifth exemplary embodiment and demonstrates the collapsing that occurs if need be during the passage through a wiper.
Figure 21:
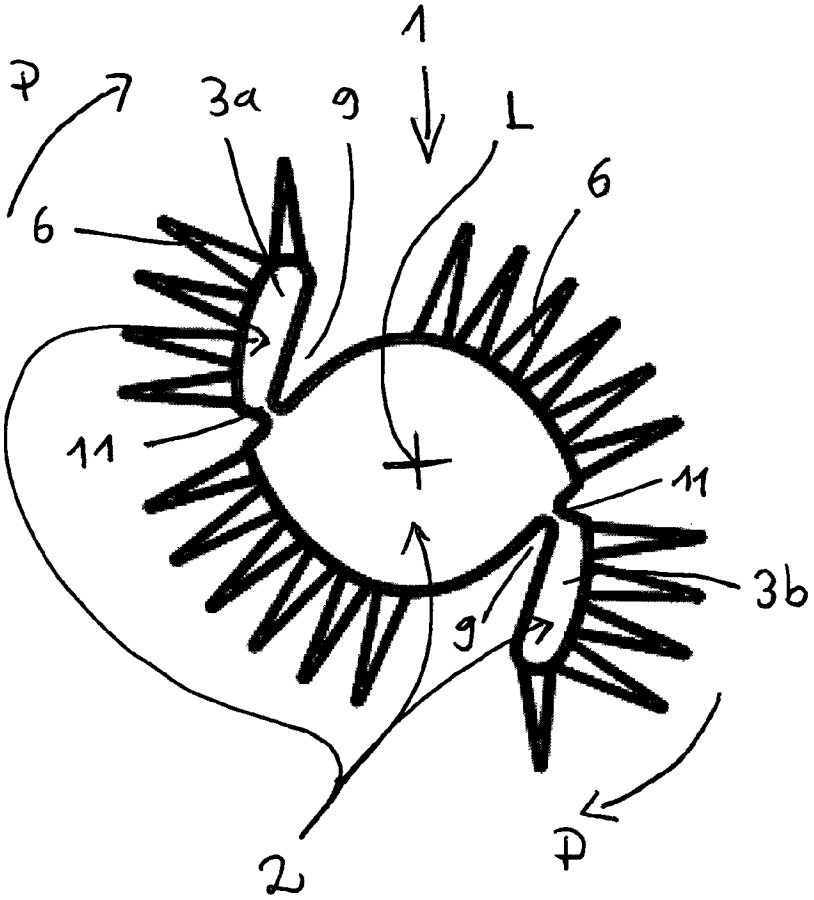
FIG. 21 shows a front view of a fifth exemplary embodiment in the relaxed state.

FIGS. 21 and 22 show another exemplary embodiment of the applicator according to the invention. This additional exemplary embodiment of the invention differs from the exemplary embodiment explained above only in that it is a so-called 1-p applicator, which is composed of a single plastic and as a rule, is produced in only a single shot by means of injection molding.

Because of this, all of the explanations of the preceding exemplary embodiment also apply in the same way to this additional exemplary embodiment, with the exception of the explanations of the preceding exemplary embodiment that arise with regard to the presence of the tube 12 and that relate to the special features that this entails.

FIG. 22 once again illustrates the mobility of the arms 3*a*, 3*b*, which has already been discussed in the description of the preceding exemplary embodiment.

FIGS. 23 through 27 show another exemplary embodiment of the invention. That which has been said above with regard to the preceding exemplary embodiment applies analogously to this additional exemplary embodiment, provided that nothing to the contrary ensues from the differences explained below.

Figure 23:
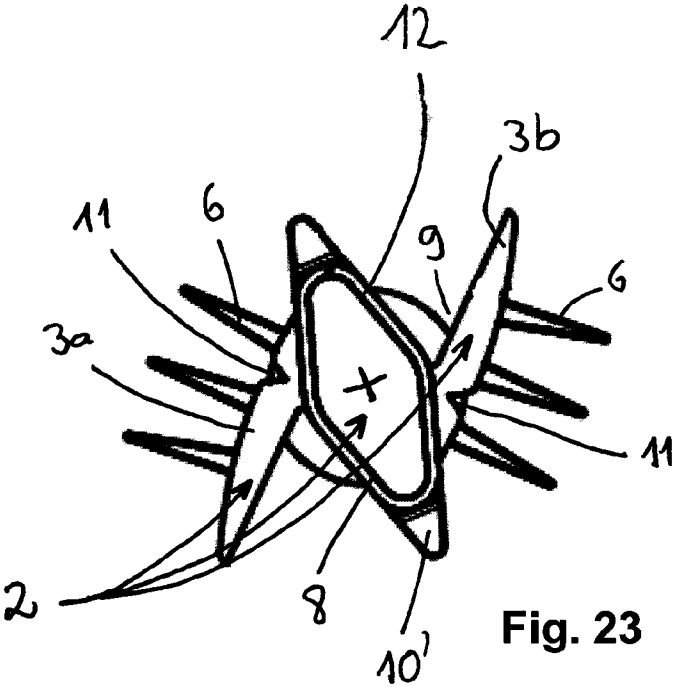
FIG. 23 shows a front view of a sixth exemplary embodiment in the relaxed state.
Figure 25:
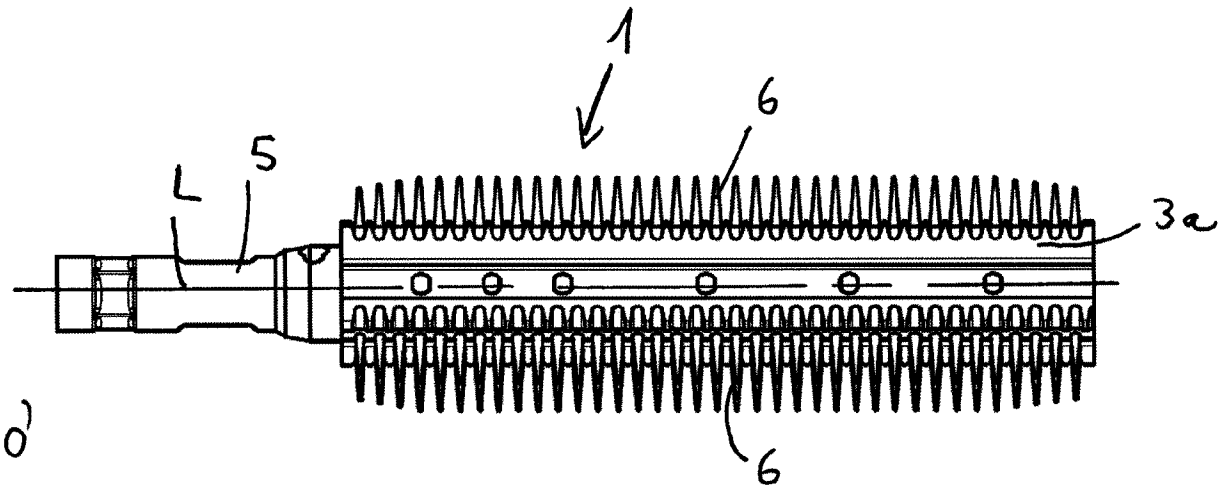
FIG. 25 shows a view of the sixth exemplary embodiment from below.
Figure 26:
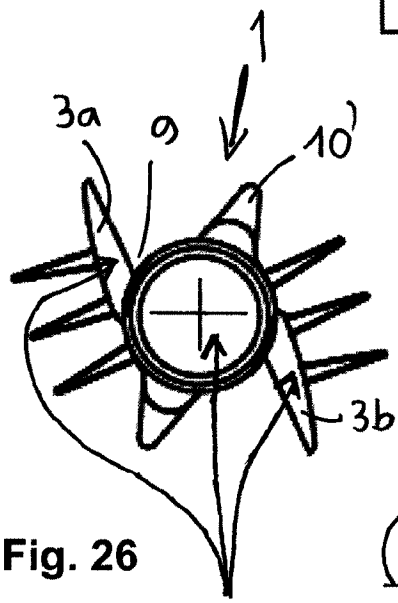
FIG. 26 shows a rear view of a sixth exemplary embodiment in the relaxed state—viewed from the coupling section 3.
Figure 27:
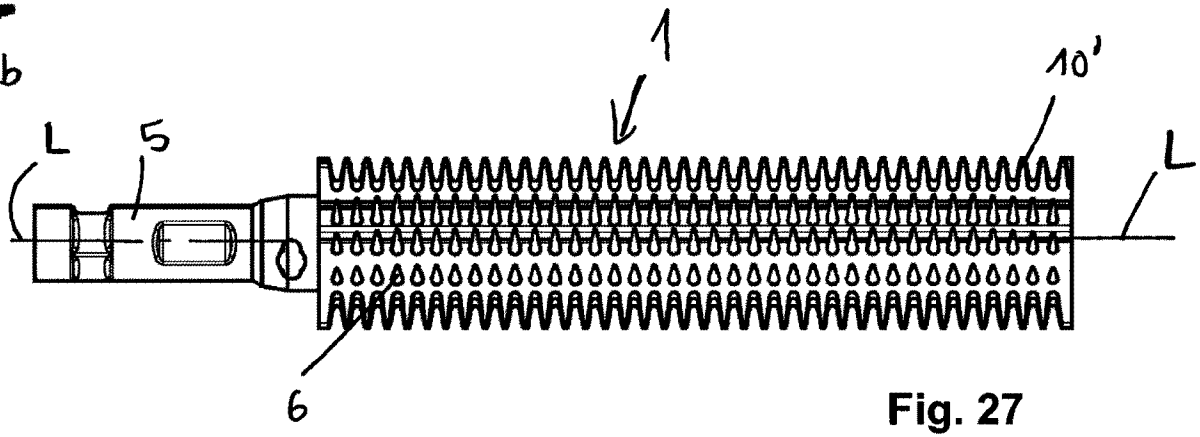
FIG. 27 shows a side view of the sixth exemplary embodiment.

In the production of this exemplary embodiment, a tube 12 is once again produced in a first step, which as a rule transitions integrally into a coupling section 5 that also serves the purpose explained above. FIG. 23 shows what this tube looks like.

The tube 12 used for this exemplary embodiment preferably has a rhomboid cross-section. It is advantageously composed of a first plastic.

In any case, this tube 12 differs from the tube 12 used in the above-mentioned exemplary embodiment in that from the outset, it has tines 10' that are composed of the material of the tube and that form a comb (comb tines). If the tube 12 is embodied as rhomboid, then the comb tines are preferably embodied on one or both of the acute-angles edges of the tube 12.

Figure 24:
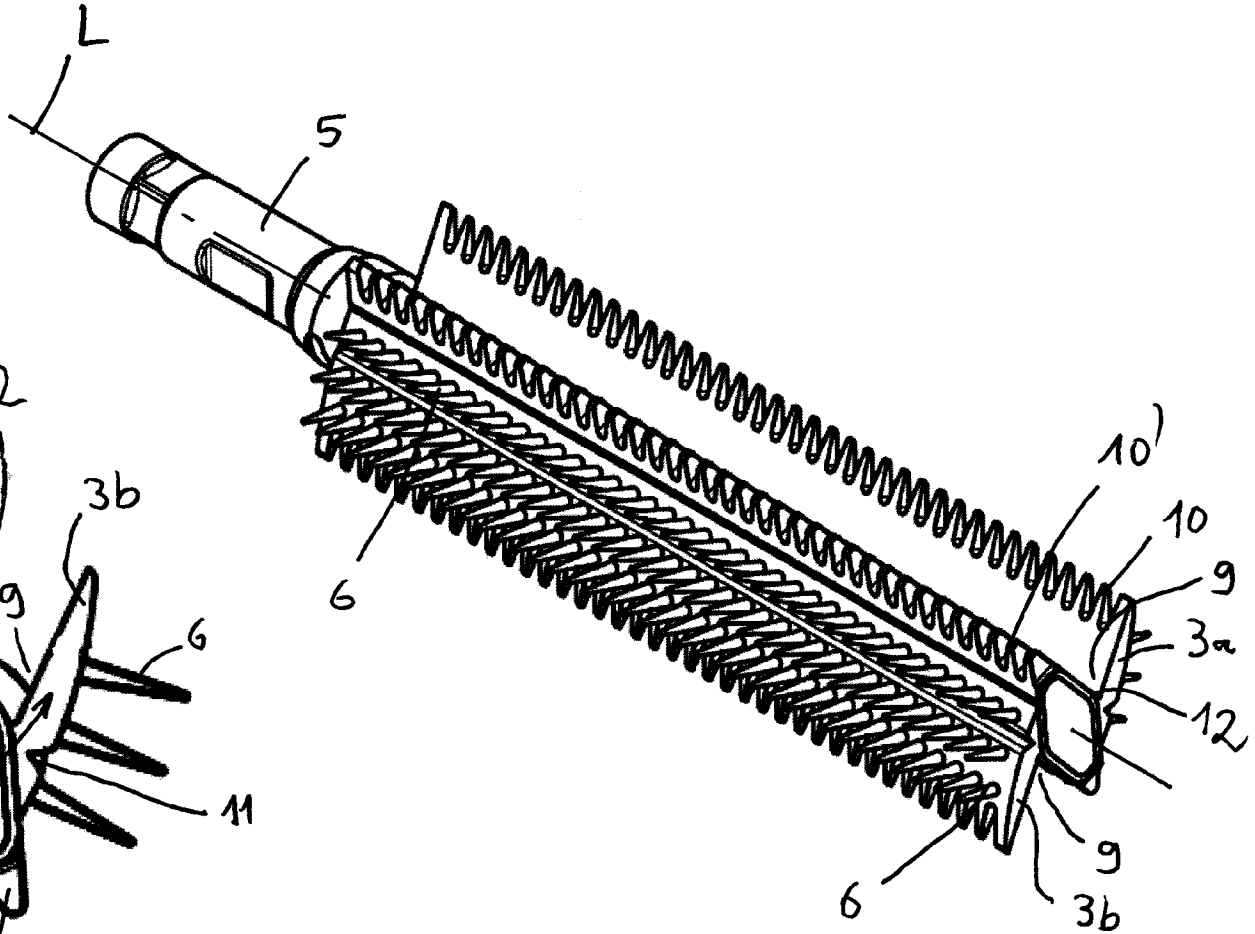
FIG. 24 shows a perspective view of the sixth exemplary embodiment obliquely from the front.

In this exemplary embodiment as well, the sequence is preferably for a second plastic to be injected into the initially hollow interior of the tube 12. In the course of this, the second plastic pierces the wall of the tube, at least locally at one or more locations in the manner described above. It can thus shoot into the mold cavity, which is situated beyond the outer circumference of the tube and which forms the respective wing and its row of bristles or field of bristles that is preferably composed of a plurality of rows of bristles 6 extending in parallel fashion in the direction of the longitudinal axis of the applicator. It is particularly preferable if a wing, at its end oriented away from the central body 8, has a row of additional comb tines 10' as shown in FIG. 24.

Alternatively, the wall of the tube can be provided with one or more hole(s) or opening(s) from the outset, through which the second plastic compound can travel into the cavity that respectively forms the wing and its bristles, as already explained in connection with the first exemplary embodiment that uses a tube 12.

In this exemplary embodiment as well, the second plastic is preferably a plastic that is more elastic than the first plastic, as explained above.

This yields the applicator, which is shown from the front in FIG. 23. In this case, two arms protrude from the base body, which preferably enclose an acute-angled gap with the base body.

FIG. 23 clearly shows that in this exemplary embodiment as well, each of the arms 3*a*, 3*b* is provided with a thin part 11, which forms a kind of hinge around which each of the arms can move in the direction toward the central body 8 under the influence of the forces that occur during application. As is clear from FIG. 24, the thin part 11 extends along the entire arm 3*a*, 3*b* in the direction parallel to the longitudinal axis L of the applicator.

It can be said in conclusion that the invention proposes a cosmetic applicator with a core and bristles protruding outward from it, which is distinguished by the fact that the core is flexible at least in some regions so that the cross-sectional area occupied by the core, as it passes through the wiper and/or the neck of the cosmetic container associated with the cosmetic applicator, reversibly decreases under the influence of the forces that the wiper and/or the bottle neck of the cosmetic container exert(s) on the core. In other words, this produces an applicator, which has a core that as such (not only its bristles), flexes at least in some regions so that its diameter as a whole decreases while the core is being pulled through the wiper and/or the neck of the cosmetic container. Preferably, the core collapses as it passes through the wiper and/or the bottle neck and then opens up to its original size again immediately after passing through the wiper and/or the bottle neck. Separate protection is also claimed for this, independent of the originally asserted claims.

The core here is embodied so that it collapses even before the forces, which the wiper and/or the bottle neck exert(s) on the applicator as the latter is being pulled out/slid back in, become so great that there is a risk of damage to the bristles.

It is thus possible to produce applicators with a core that has an enlarged diameter without simultaneously also having to produce a new container and/or a new wiper that must both have a comparably enlarged diameter.

Independent protection is also claimed for a cosmetic applicator that is composed of a slotted tube, as shown in FIGS. 1 through 4, and has one or more structural details as described above for this applicator type and differs from the applicators of this type described up to this point only in that its slotted tube does not—or essentially does not—deform under the influence of the forces that occur during use, including withdrawal from the container.

Independent protection is also claimed for a cosmetic applicator that is composed of a central body 8 with arms (3*a*, 3*b*, 3*c*, 3*d*) protruding from it, as shown in FIGS. 7 through 27, and has one or more structural details as described above for this applicator type and differs from the applicators of this type described up to this point only in that its arms do not—or essentially do not—move under the influence of the forces that occur during use, including withdrawal from the container (i.e. apart from the certain amount of elastic deformation under load of less than 5/10 mm that is inherent in each body).

The invention claimed is:

1. A cosmetic applicator, comprising:

a plurality of application elements in the form of bristles, comb tines, or a combination of bristles and comb tines; and a core that supports the plurality of application elements and has a central body that is equipped with a plurality of bristles, comb tines, or a combination of bristles and comb tines protruding out directly from the central body, wherein the core further comprises at least one arm that protrudes out from the central body and is equipped with a plurality of bristles, comb tines, or a combination of bristles and comb tines, and the at least one arm is attached to the core or to the central body with a hinge or a decrease in wall thickness that extends, parallel to a longitudinal axis of the central body such that the at least one arm is mobile around an axis that is parallel to the longitudinal axis of the central body and the at least one arm swivels to lie down against the central body of the core under an influence of forces, thus reducing a cross-section of the core.

2. The cosmetic applicator according to claim 1, wherein the core has a U-shaped, C-shaped, S-shaped or Z-shaped cross-section along an entire longitudinal length of the core.

3. The cosmetic applicator according to claim 1, wherein the at least one arm is attached with a film hinge to the core or to the central body.

4. The cosmetic applicator according to claim 1, wherein the core, the at least one arm, or both the core, and the at least one arm is/are composed of a flexible plastic.

5. The cosmetic applicator according to claim 1, wherein the core and its bristles are injection molded in a single work step out of the same material.

6. The cosmetic applicator according to claim 1, wherein the bristles are composed of a different material than the core, which material has been subsequently injection molded onto the core from the outside and thus intimately bonded or welded to the core.

7. The cosmetic applicator according to claim 1, wherein the bristles are composed of a second plastic, which is injection molded into a first plastic of the core, of the arms, or of both the core and the arms.

8. The cosmetic applicator according to claim 7, wherein the central body is composed of a tube, which is made of the first plastic and is filled on the inside with the second plastic.

9. The cosmetic applicator according to claim 8, wherein the tube has first openings, through which the second plastic that fills the central body reaches, forming bristles on the outside of the tube.

10. The cosmetic applicator according to claim 9, wherein the tube has at least one second opening through which the second plastic that fills the tube reaches, forming at least one of the arms on the outside of the tube.

11. The cosmetic applicator according to claim 1, wherein a plurality of arms protrude outward from the central body of the core in a star shape so that all of the arms are spaced equidistantly apart from one another in an unstressed state.

12. The cosmetic applicator according to claim 1, Wherein each of the at least one arms is a solid strip that is attached on one side and extends in a direction parallel to a longitudinal axis of the applicator along at least most of the central body, not including a coupling section of the central body.

13. A system composed of the applicator according to claim 1, a cosmetic container, and a wiper fastened thereto, wherein the wiper and the applicator are matched to each other so that the applicator collapses as it is being pulled through the wiper, pushed through the wiper, or both pulled and pushed through the wiper.

14. A cosmetic applicator, comprising:

a plurality of application elements in the form of bristles, comb tines, or a combination of bristles and comb tines; and a core that supports the plurality of application elements and has a central body that is equipped with a plurality of bristles, comb tines, or a combination of bristles and comb tines protruding out directly from the central body, wherein the core further comprises at least one arm that protrudes out from the central body and is equipped with a plurality of bristles, comb tines, or a combination of bristles and comb tines, and the core is composed of a slotted tube from which the at least one arm protrudes, wherein the slotted tube has a continuous slot extending along an entire longitudinal length of the core, the slotted tube is open at a distal end so that deformation of the tube is not hindered at the distal end, and the core is flexible at least in some regions so that a cross-sectional area occupied by the core, as the core passes through a wiper, a bottle neck, or through both a wiper and a bottle neck of a cosmetic container associated with the cosmetic applicator, automatically and reversibly decreases under an influence of forces exerted by the wiper, the bottle neck, or both the wiper and the bottle neck of the cosmetic container.

15. The cosmetic applicator according to claim 14, wherein the at least one arm protruding from the rod-shaped central body is equipped with bristles and is elastic so that under the influence of the forces exerted by the wiper, the bottle neck, or both the wiper and the bottle neck of the cosmetic container, the at least one arm reversibly moves in a direction toward a central region of the core.

* * * * *